US007067468B2

(12) United States Patent
DeGroot et al.

(10) Patent No.: US 7,067,468 B2
(45) Date of Patent: Jun. 27, 2006

(54) AZEOTROPE COMPOSITIONS CONTAINING A FLUOROCYCLOPENTANE

(76) Inventors: Richard J. DeGroot, 19222 Dorset St., Southfield, MI (US) 48075; Dov Shellef, 135 Station Rd., Great Neck, NY (US) 11023

( * ) Notice: Subject to any disclaimer, the term of this patent is extended or adjusted under 35 U.S.C. 154(b) by 238 days.

(21) Appl. No.: 10/601,228

(22) Filed: Jun. 20, 2003

(65) Prior Publication Data

US 2004/0259752 A1 Dec. 23, 2004

(51) Int. Cl.
*C11D 7/50* (2006.01)

(52) U.S. Cl. ..... 510/411; 510/408; 510/410; 510/412

(58) Field of Classification Search ..... 510/365, 510/175, 412, 411, 273; 252/67; 134/40; C23G 5/28
See application file for complete search history.

(56) References Cited

U.S. PATENT DOCUMENTS

| | | | | |
|---|---|---|---|---|
| 5,492,641 | A | 2/1996 | Mohr et al. | |
| 5,599,783 | A * | 2/1997 | Ide et al. | 510/412 |
| 5,827,812 | A | 10/1998 | Flynn et al. | |
| 5,858,953 | A | 1/1999 | Aman et al. | |
| 6,048,833 | A | 4/2000 | DeGroot et al. | |
| 6,166,276 | A | 12/2000 | Sakyu et al. | |
| 6,204,237 | B1 | 3/2001 | Suzuki et al. | |
| 6,218,586 | B1 * | 4/2001 | Takada et al. | 570/165 |
| 6,274,543 | B1 * | 8/2001 | Milbrath et al. | 510/412 |
| 6,312,759 | B1 * | 11/2001 | Yamada et al. | 427/131 |
| 6,402,857 | B1 | 6/2002 | Clark et al. | |
| 6,403,846 | B1 * | 6/2002 | Sekiya et al. | 570/134 |
| 6,426,327 | B1 | 7/2002 | Flynn et al. | |

FOREIGN PATENT DOCUMENTS

| | | |
|---|---|---|
| GB | 2270699 | 3/1994 |
| JP | 11-152236 | 6/1999 |
| JP | 11-3263065 | 3/2002 |
| WO | WO 00/56833 | 3/2000 |

* cited by examiner

*Primary Examiner*—Gregory Webb
(74) *Attorney, Agent, or Firm*—Kean, Miller, Hawthorne, D'Armond, McCowan & Jarman, L.L.P.

(57) ABSTRACT

Novel azeotrope compositions comprised of a mixture of a fluorocyclopentane with a solvent selected from the group consisting of 1-bromopropane, t-dichloroethylene, and methylene chloride. Such compositions are useful as solvents in refrigeration flushing, oxygen system cleaning, foam blowing, and cleaning operations such as cold cleaning, vapor degreasing, and aerosol cleaners.

26 Claims, No Drawings

AZEOTROPE COMPOSITIONS CONTAINING A FLUOROCYCLOPENTANE

FIELD OF THE INVENTION

This invention relates to novel azeotrope compositions comprised of a mixture of a fluorocyclopentane with a solvent selected from the group consisting of 1-bromopropane, t-dichloroethylene, and methylene chloride. Such compositions are useful as solvents in refrigeration flushing, oxygen system cleaning, foam blowing, paints, adhesives, lubricants, and cleaning operations such as cold cleaning, vapor degreasing, and aerosol cleaners.

BACKGROUND OF THE INVENTION

1-Bromopropane based fluids have found widespread use in industry for uses such as solvent cleaning, i.e. vapor degreasing, cold cleaning and ultrasonic cleaning of complex metal parts, circuit boards, electronic components, implantable prosthetic devices, optical equipment and others.

For difficult to remove soils where elevated temperature is necessary to improve the cleaning action of the solvent, or for large volume assembly line operations where the cleaning of metal parts and assemblies must be done efficiently, a vapor degreaser is employed. In its simplest form, vapor degreasing, consists of exposing a room temperature object to be cleaned to the vapors of a boiling solvent. Vapors condensing on the object provide clean distilled solvent to wash away grease or other contaminants. Final evaporation of the solvent from the object leaves no residue on the object.

Azeotropic or azeotrope-like solvent compositions are particularly desired because they do not fractionate upon boiling. This behavior is desirable because in the previously described vapor degreasing equipment, in which such solvents are employed, redistilled solvent is generated for final rinse cleaning. Thus, the vapor degreasing system acts as a still. Unless the solvent composition exhibits a constant boiling point, i.e., is azeotrope-like, fractionation will occur and undesirable solvent distribution may upset the cleaning and safety of the process.

Azeotropic mixtures of 1-bromopropane are also advantageous in the foam blowing industries. In foam blowing applications 1-bromopropane suffers from the disadvantage in that it is too aggressive a solvent and results in considerable shrinkage of foam in foam blowing applications. Mixtures comprised of less aggressive solvents, in particular azeotropic mixtures, can be used to offset this disadvantage.

Azeotropic mixtures are also advantageous in systems where various materials are dissolved in the solvent mixture and deposited on a substrate upon evaporation of the solvent. Such systems include paints, coatings, adhesives, and lubricants. Azeotropes are preferred for such systems since the solubility parameters of the solvent system remains relatively constant as the azeotrope evaporates.

The art is continually seeking new solvent mixtures that have improved properties for the above-described applications. Currently, environmentally acceptable materials are of particular interest because the traditionally used fully halogenated chlorocarbons and chlorofluorocarbons have been implicated in causing environmental problems associated with the depletion of the earth's protective ozone layer.

Mathematical models have substantiated that 1-bromopropane will not adversely affect atmospheric chemistry because its contribution to stratospheric ozone depletion and global warming in comparison to the fully halogenated chlorocarbons and chlorofluorocarbons species is negligible. 1-Bromopropane has an ODP of 0.002–0.03 which is significantly lower than the ODPs of 1,1,2-trichloro-1,2,2-trifluoroethane or CFC-113 (0.8) and 1,1-dichloro-1-fluoroethane or HCFC-141b (0.11). The global warming potential (GWP) of 1-bromopropane (0.31) is also significantly lower than CFC-113 (5000) and HCFC-141b (630).

The art has also looked to compositions that include components that contribute additional desired characteristics, such as polar functionality, increased solvency power, and increased stability while retaining those properties exhibited by prior art chlorofluorocarbons including chemical stability, low toxicity, and non-flammability.

It is accordingly an object of this invention to provide novel solvent compositions based on 1-bromopropane and at least one other organic solvent, and which is azeotropic or azeotropic-like compositions, which compositions are useful in solvent and other applications mentioned above.

SUMMARY OF THE INVENTION

In accordance with the present invention there is provided azeotrope compositions comprised of: a first component comprised of at least one compound selected from the fluorocyclopentanes wherein a fluorine atom is substituted for from 1 to 9 hydrogen atoms; and a second component comprised of at least one compound selected from the group consisting of 1-bromopropane, t-dichloroethylene, and methylene chloride, wherein the amounts of each compound are selected so the final composition is an azeotrope.

In a preferred embodiment the fluorocyclopentane is selected from those containing from about 3 to 9 fluorine atoms and the second component is 1-bromopropane.

In still another preferred embodiment, the fluorocyclopentane is 1,1,2,2,3,3,4-heptafluorocyclopentane.

In yet another preferred embodiment, the composition also contains a alcohol selected from methanol, ethanol, 1-propanol, and 2-propanol.

DETAILED DESCRIPTION OF THE INVENTION

As mentioned above, the present invention relates to novel azeotropic compositions comprising effective amounts one or more fluorocyclopentane compounds containing from 1 to 9 fluorine atoms and a second component comprised of at least one solvent selected from the group consisting of 1-bromopropane, t-dichloroethylene, and methylene chloride, preferably is 1-bromopropane. There may also be a third component present, which third component is one or more alcohols selected from the group consisting of methanol, ethanol, 1-propanol, and 2-propanol. The amount of each ingredient is chosen so that the final composition is an azeotropic composition. These azeotropic compositions are effective in their use as cleaning agents. It is to be understood that, for purposes of this invention, the terms "azeotrope" and "azeotropic" also encompass the terms "azeotrope-like" and "azeotropic-like", as ordinarily used by those having ordinary skill in the art.

An azeotrope is a mixture of two or more substances that behaves like a single substance in that the vapor produced by partial evaporation of liquid has the same composition as the liquid. The substantially constant boiling mixture exhibits either a maximum or minimum boiling point, typically a minimum, as compared with other mixtures of the same substances.

The term azeotrope-like is intended to mean that the compositions behave like true azeotropes in terms of its substantially constant boiling characteristics or its tendency not to separate thru the distillation process or upon evaporation at ambient temperatures. Such systems exhibit only slight changes in solvent concentrations as the mixture evaporates or is distilled.

An azeotropic mixture by definition must at least two or more components. The most common azeotropic systems are binary azeotropes and contain two components. Ternary azeotropes contain three components. Azeotropes of four or more components also exist but tend to have less real practicle value. However, all azeotropes of one, two, three or more components all exhibit and follow the priciples outlined below.

It follows from the above that another characteristic of azeotrope-like compositions is that there is a range of compositions containing the same components in varying proportions which are azeotrope-like. For example, it is well know that the concentration of an azeotrope will vary relative to the pressure of the system. A person skilled in the art of distillation understands that changing the pressure of the system will change the concentration of each component of the azeotrope. All such compositions are intended to be covered by the term azeotrope-like as used herein.

It is also well know in the art of distillation that if compound A forms an azeotrope with a second compound, compound B, it is expected that all isomers of compound A will also azeotrope with compound B. For example, xylene will azeotrope with n-butyl alcohol. This statement implies that all three isomers, o,m, and p-xylene will azeotrope with n-butyl alcohol, which literature shows is the case.

One way to determine if a mixture is an azeotrope is thru fractional distillation. Firstly, a fractional distillation column will perform multiple steps of evaporation and condensation of the mixture. Such a system is designed to separate a mixture of liquids of components into pure components utilizing the differences in their boiling points. If the mixture does not separate by fractional distillation it can be said to be azeotrope-like. Analyzing the distilled fractions from a fractional distillation column will identify the concentrations of the azeotropic mixture.

Secondly, a fractional distillation column will accurately determine the boiling point of the azeotrope. If a maximum or minimum temperature is reached relative to the individual components, by definition, and azeotrope exists.

While fluorocyclopentanes can be used wherein 1 to 9 hydrogens have been substituted with fluorine atoms, it is preferred that only 3 to 9 hydrogens be substituted with fluorine atoms, and it is more preferable that 6 to 8 be substituted, and most preferred is when the fluorocyclopentane is 1,1,2,2,3,3,4-heptafluorocyclopentane.

The second solvent component of the blend compositions of the present invention is selected from 1-bromopropane, t-dichloroethylene, and methylene chloride, with 1-bromoppropane being preferred, thus forming a binary azeotrope with fluorocyclopentane.

A third solvent component can also be present, which third solvent component is an alcohol component thereby resulting in a ternary azeotrope when mixed with the first and second components. The preferred alcohol component is one or more selected from the group consisting of methanol, ethanol, 1-propanol, and 2-propanol.

It should be understood that the present compositions may include one or more additives, such as stabilizers, inhibitors, surfactants, and antioxidants, some of which may form new azeotrope-like compositions. Such additives typically are added at the expense of 1-bromopropane and in amounts known to one skilled in the art. Preferably, the total amount of such additives are used in an amount of up to about 5 weight percent based on the weight of the total weight of the composition, and more preferably in an amount of up to about 5 weight percent based on the total weight of bromopropane content. Any such compositions are considered to be within the scope of the present invention as long as the compositions contain all of the essential components described herein.

Stabilizers typically are added to solvent compositions to inhibit decomposition of the compositions; stabilizers react with undesirable decomposition products of the compositions; and/or prevent corrosion of metal surfaces. Any combination of conventional stabilizers known to be useful in stabilizing halogenated hydrocarbon solvents may be used in the present invention. Suitable stabilizers include alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable stabilizers will readily occur to those skilled in the art.

The compositions of the present invention are prepared by admixing the fluorocyclopentane component and a sufficient amount of the second component, preferably 1-bromopropane to provide the desired azeotropic cleaning solvent composition. The order of addition of the components is not critical for this invention. When desired, stabilizers and co-solvents may be added. In addition, minor amounts of surfactants can also be included. Typical surfactants useful for the invention include ionic and non-ionic surface active agents, for example, sulfonate salts, phosphate salts, carboxylate salts, fatty acids, alkyl phenols, glycols, esters and amides. Surface active agents also include ionic and non-ionic water displacement compounds such as tetraalkyl ammonium sulfonate, phosphate, and carboxylate and bromide salts, aliphatic amino alkanols, fluorinated amino alkanols, and chlorofluorinated amino alkanols. Again the order of addition is not critical for the present invention.

The azeotropic compositions of the present invention may be used to clean solid surfaces by treating said surfaces with said compositions in any manner well known in the art such as by dipping or use of open or closed vapor degreasing apparatus. For example, the solvent compositions of the present invention are suitable for washing articles having cloth, metal, ceramic, plastic and elastomeric surfaces. The solvent compositions of the present invention may be applied by any method known or commonly used to clean or degrease articles. For example, the surface of the article may be wiped with an absorbent medium containing the solvent composition such as a cloth saturated with the solvent. The article may be submerged or partially submerged in a dip tank. The solvent in a dip tank can be either hot or cold, and the article can be submerged for extended periods of time without inducing decomposition of the solvent. Furthermore, the article, dip tank, and related components are not harmed by the process. Alternatively, the solvent can be sprayed onto the article or the article can be cleaned in a vapor degreasing chamber with either liquid or vaporized solvent composition.

When the solvent is applied as a vapor, the solvent is typically heated in a solvent reservoir to vaporize the solvents. The vaporized solvent then condenses on the surface of the article. The condensed solvent solvates or entrain grease, oil, dirt, and other undesirable particles that are on the article's surface. The contaminated solvent drains into the solvent reservoir carrying the dissolved and entrained material to the reservoir. Since only the solvent is vaporized, the grease, oil, and dirt remain in the reservoir, and the article is continually flushed with non-contaminated solvents.

As previously mentioned, non-limiting examples of other uses for the azeotropic compositions of the present invention include their use as solvents for refrigeration flushing; in oxygen system cleaning; in form blowing, in paints, in adhesives, in lubricants, and in systems for depositing an material onto a substrate.

The invention will be described in greater detail by way of specific examples. The following examples are offered for illustrative purposes, and are intended neither to limit nor define the invention in any manner.

EXAMPLES

The range over which the following compositions exhibit constant boiling behavior was determined using fractional distillation. A 45 mm mirrored-vacuum-jacketed distillation column packed with Raschig rings equipped with a cold-water condenser and an automatic liquid dividing head were used to confirm the composition of azeotropic compositions. The distillation column was charged with the solvent mixture and the resulting composition was heated under total reflux for about a half an hour to ensure equilibration. A reflux ratio of 5:1 was employed to remove the distillate fraction. The compositions of the overhead fractions were analyzed using Gas Chromatography and are reported in the tables below.

Preferred and more preferred embodiments for each azeotrope or azeotrope-like composition of the present invention are set forth in the tables below. The numerical ranges are understood to be prefaced by "about".

TABLE I

Physical Properties

| Solvent | Boiling Pt (° C.) |
|---|---|
| (ProBr) 1-bromopropane | 71 |
| (PFB) 1,1,1,3,3-pentafluorobutane | 40 |
| (HFCP) 1,1,2,2,3,3,4-heptafluorocyclopentane | 82 |
| (t-DCE) t-Dichloroethylene | 48 |
| (MeOH) Methanol | 64 |
| (EtOH) Ethanol | 78 |
| (1-ProOH) 1-Propanol | 97 |
| 2-Propanol | 82 |
| Pentane | 36 |

TABLE II

Azeotropes Identified

| A Component | B Component | C Component | BP (° C.) | % A | % B | % C |
|---|---|---|---|---|---|---|
| HFCP | ProBr | * | 67 | 41 | 59 | * |
| HFCP | ProBr | Methanol | 55 | 22 | 61 | 17 |
| HFCP | ProBr | Ethanol | 61 | 31 | 60 | 9 |
| HFCP | ProBr | 1-Propanol | 66 | 40 | 57 | 3 |
| HFCP | ProBr | 2-Propanol | 65 | 35 | 55 | 10 |
| HFCP | t-DCE | * | 47 | 18 | 82 | * |
| HFCP | t-DCE | MeOH | 42 | 10 | 87 | 3 |

* signify binary azeotrope

TABLE III

Preferred compositions

| A Component | B Component | C Component | BP (° C.) | % A | % B | % C |
|---|---|---|---|---|---|---|
| HFCP | ProBr | * | 67 | 10–70 | 20–90 | * |
| HFCP | ProBr | Methanol | 55 | 1–50 | 30–90 | 1–40 |
| HFCP | ProBr | Ethanol | 61 | 1–60 | 30–90 | 0.5–40 |
| HFCP | ProBr | 1-Propanol | 66 | 10–70 | 25–85 | 0.5–35 |
| HFCP | ProBr | 2-Propanol | 65 | 5–65 | 25–85 | 0.5–40 |
| HFCP | t-DCE | * | 47 | 1–50 | 50–99 | * |
| HFCP | t-DCE | MeOH | 42 | 0.5–40 | 55–99 | 0.1–30 |

TABLE IV

More Preferred Azeotrope Compositions

| A Component | B Component | C Component | BP (° C.) | % A | % B | % C |
|---|---|---|---|---|---|---|
| HFCP | ProBr | * | 67 | 20–60 | 30–80 | * |
| HFCP | ProBr | Methanol | 55 | 2–40 | 40–80 | 3–35 |
| HFCP | ProBr | Ethanol | 61 | 10–50 | 40–80 | 1–30 |
| HFCP | ProBr | 1-Propanol | 66 | 20–60 | 35–75 | 1–25 |
| HFCP | ProBr | 2-Propanol | 65 | 15–55 | 35–75 | 1–30 |
| HFCP | t-DCE | * | 47 | 2–40 | 60–95 | * |
| HFCP | t-DCE | MeOH | 42 | 1–30 | 65–95 | 0.5-25 |

TABLE V

Most Preferred Azeotrope Compositions

| A Component | B Component | C Component | BP (° C.) | % A | % B | % C |
|---|---|---|---|---|---|---|
| HFCP | ProBr | * | 67 | 30–50 | 40–70 | * |
| HFCP | ProBr | Methanol | 55 | 10–30 | 50–70 | 10–25 |
| HFCP | ProBr | Ethanol | 61 | 20–40 | 50–70 | 2–20 |
| HFCP | ProBr | 1-Propanol | 66 | 30–50 | 45–65 | 2–15 |
| HFCP | ProBr | 2-Propanol | 65 | 25–45 | 45–65 | 2–20 |
| HFCP | t-DCE | * | 47 | 5–30 | 70–90 | * |
| HFCP | t-DCE | MeOH | 42 | 5–20 | 75–95 | 1–15 |

What is claimed is:

1. An azeotrope composition comprised of: a first component comprised of at least one compound selected from the fluorocyclopentanes wherein a fluorine atom is substituted for from 3 to 9 hydrogen atoms; and a second component comprised of 1-bromopropane, wherein the amounts of each component are selected so that the final composition is an azeotrope.

2. The composition of claim 1 wherein the fluorocyclopentane is 1,1,2,2,3,3,4-heptafluorocyclopentane.

3. The composition of claim 2 wherein there is also present at least one alcohol selected from the group consisting of methanol, ethanol, 1-propanol, and 2-propanol.

4. The composition of claim 1 wherein there is also present at least one alcohol selected from the group consisting of methanol, ethanol, 1-propanol, and 2-propanol.

5. The composition of claim 1 wherein there is also provided another component selected from ethers, ketones, alkanes, alkenes, cycloalkanes, halogenated alkanes, and halogenated alkenes.

6. The composition of claim 1 comprised of about 20 to about 90 wt. % 1-bromopropane and from about 10 to about 80 wt. % 1,1,2,2,3,3,4-heptafluorocyclopentane wherein said composition boils from about 65° C. to about °69° C. at 760 mm Hg.

7. The composition of claim 6 comprised of about 40 to about 80 wt. % 1-bromopropane, from about 20 to about 60 wt. % 1,1,2,2,3,3,4-heptafluorocyclopentane wherein said composition boils from about 65° C. to about °69° C. at 760 mm Hg.

8. The compositions of claim 3 comprised of about 40 to about 80 wt. % 1-bromopropane, about 2 to about 42 wt. % 1,1,2,2,3,3,4-heptafluorocyclopentane, and from about 3 to about 37 wt. % methanol, and wherein said composition boils at about 53° C. to about 57° C. at 760 mm Hg.

9. The composition of claim 3 comprised of about 40 to about 80 wt. % 1-bromopropane, about 11 to about 41 wt. % 1,1,2,2,3,3,4-heptafluorocyclopentane, and from about 1 to about 30 wt. % ethanol, and wherein said compositions boils at about 59° C. to about 63° C. at 760 mm Hg.

10. The composition of claim 3 comprised of about 35 to about 75 wt. % 1-bromopropane, about 20 to about 60 wt. % 1,1,2,2,3,3,4-heptafluorocyclopentane, and from about 1 to about 24 wt. % 1-propanol, and wherein said composition boils at about 64° C. to about 68° C. at 760 mm Hg.

11. The composition of claim 3 comprised of about 35 to about 75 wt. % 1-bromopropane, about 15 to about 55 wt. % 1,1,2,2,3,3,4-heptafluorocyclopentane, and from about 1 to about 30 wt. % 2-propanol wherein said composition boils at about 63° C. to about 67° C. at 760 mm Hg.

12. The composition of claim 1 wherein there is also present and effective amount of one or more additives selected from the group consisting of acid acceptors, metal passivators, stabilizing agents, and surface-active agents, which effective amount is an amount that will maintain an azeotropic composition.

13. The composition of claim 8 wherein there is also present and effective amount of one or more additives selected from the group consisting of acid acceptors, metal passivators, stabilizing agents, and surface-active agents, which effective amount is an amount that will maintain an azeotropic composition.

14. A method for cleaning an organic contaminant from the surface of a solid substrate, which method comprises contacting said solid substrate at effective conditions with an effective amount of a solvent mixture comprised of a first component comprised of at least one compound selected from the fluorocyclopentanes wherein a fluorine atom is substituted for from 3 to 9 hydrogen atoms; and a second component comprised of 1-bromopropane wherein the amounts of each component are selected so that the final composition is an azeotrope.

15. The method of claim 14 wherein the fluorocyclopentane is 1,1,2,2,3,3,4-heptafluorocyclopentane.

16. The method of claim 15 wherein there is also present at least one alcohol selected from the group consisting of methanol, ethanol, 1-propanol, and 2-propanol.

17. The method of claim 14 wherein there is also present at least one alcohol selected from the group consisting of methanol, ethanol, 1-propanol, and 2-propanol.

18. The method of claim 14 wherein there is also provided another component selected from ethers, ketones, alkanes, alkenes, cycloalkanes, halogenated alkanes, and halogenated alkenes.

19. The method of claim 14 comprised of about 20 to about 90 wt. % 1-bromopropane and from about 10 to about 80 wt. % 1,1,2,2,3,3,4-heptafluorocyclopentane wherein said composition boils from about 65° C. to about °69° C. at 760 mm Hg.

20. The method of claim 19 comprised of about 40 to about 80 wt. % 1-bromopropane, from about 20 to about 60 wt. % 1,1,2,2,3,3,4-heptafluorocyclopentane wherein said composition boils from about 65° C. to about °69° C. at 760 mm Hg.

21. The method of claim 16 comprised of about 40 to about 80 wt. % 1-bromopropane, about 2 to about 42 wt. % 1,1,2,2,3,3,4-heptafluorocyclopentane, and from about 3 to about 37 wt. % methanol, and wherein said composition boils at about 53° C. to about 57° C. at 760 mm Hg.

22. The method of claim 16 comprised of about 40 to about 80 wt. % 1-bromopropane, about 11 to about 41 wt. % 1,1,2,2,3,3,4-heptafluorocyclopentane, and from about 1 to about 30 wt. % ethanol, and wherein said compositions boils at about 59° C. to about 63° C. at 760 mm Hg.

23. The method of claim 16 comprised of about 35 to about 75 wt. % 1-bromopropane, about 20 to about 60 wt. % 1,1,2,2,3,3,4-heptafluorocyclopentane, and from about 1 to about 24 wt. % 1-propanol, and wherein said composition boils at about 64° C. to about 68° C. at 760 mm Hg.

24. The method of claim 16 comprised of about 35 to about 75 wt. % 1-bromopropane, about 15 to about 55 wt. % 1,1,2,2,3,3,4-heptafluorocyclopentane, and from about 1 to about 30 wt. % 2-propanol wherein said composition boils at about 63° C. to about 67° C. at 760 mm Hg.

25. The method of claim 14 wherein there is also present and effective amount of one or more additives selected from the group consisting of acid acceptors, metal passivators, stabilizing agents, and surface-active agents, which effective amount is an amount that will maintain an azeotropic composition.

26. The method of claim 21 wherein there is also present and effective amount of one or more additives selected from the group consisting of acid acceptors, metal passivators, stabilizing agents, and surface-active agents, which effective amount is an amount that will maintain an azeotropic composition.

* * * * *